United States Patent [19]

Adamski et al.

[11] Patent Number: 4,739,215

[45] Date of Patent: Apr. 19, 1988

[54] ELECTRICAL CONDUCTION MEANS FOR USE IN TENSION MASK COLOR CATHODE RAY TUBES

[75] Inventors: Alfred Adamski, Elmhurst; Lawrence W. Dougherty, Sleepy Hollow, both of Ill.

[73] Assignee: Zenith Electronics Corporation, Glenview, Ill.

[21] Appl. No.: 947,727

[22] Filed: Dec. 30, 1986

[51] Int. Cl.[4] ..... H01J 29/28; H01J 29/88

[52] U.S. Cl. ..... 313/402; 313/466; 313/477 HC

[58] Field of Search ..... 313/402, 407, 461, 466, 313/477, 477 HC

[56] References Cited

U.S. PATENT DOCUMENTS

| | | | |
|---|---|---|---|
| 3,432,803 | 3/1969 | Nice | 339/144 |
| 3,898,510 | 8/1975 | Davis et al. | 313/482 |
| 4,333,033 | 6/1982 | Cordingley et al. | 313/407 |
| 4,344,015 | 8/1982 | Marchka | 313/477 HC X |
| 4,450,379 | 5/1984 | Kikuchi et al. | 313/477 |
| 4,652,791 | 3/1987 | Palac et al. | 313/402 |

*Primary Examiner*—David K. Moore
*Assistant Examiner*—Sandra L. O'Shea

[57] ABSTRACT

A color cathode ray tube is disclosed having an envelope including a faceplate with an electrically conductive screen, and a funnel having an electrically conductive film on its inner surface charged to a high electrical potential. An electrically insulative glass shadow mask support assembly is sealed between the faceplate and the funnel has a shelf extending into the envelope for mounting a metallic foil shadow mask in tension adjacent to the screen. The shelf has at least one hole therethrough for receiving electrical conduction means according to the invention. The electrical conduction means includes a center member for insertion into the hole, and contacting means at both extremities for contacting the electrically conductive coating on the funnel, the shadow mask, and the metallic film on the screen. As a result, and according to the invention, the high electrical potential on the conductive film of the funnel is electrically conducted through the electrically insulative glass shadow mask support assembly to the shadow mask and the screen to establish the components at a common high potential.

3 Claims, 2 Drawing Sheets

ELECTRICAL CONDUCTION MEANS FOR USE IN TENSION MASK COLOR CATHODE RAY TUBES

CROSS-REFERENCE TO RELATED APPLICATIONS AND PATENTS

This application is related to but in no way dependent upon copending applications Ser. No. 572,088 filed Jan. 18, 1984, now U.S. Pat. No. 4,547,696; Ser. No. 572,089 filed Jan. 18, 1984, now U.S. Pat. No. 4,595,857; Ser. No. 735,887 filed Aug. 8, 1984, now U.S. Pat. No. 4,656,388; Ser. No. 729,020 filed Apr. 30, 1985, now U.S. Pat. No. 4,652,791; Ser. No. 727,486 filed Apr. 26, 1985, now U.S. Pat. No. 4,695,523; and Ser. No. 743,184 filed June 10, 1986, now U.S. Pat. No. 4,678,447, all of common ownership herewith.

BACKGROUND OF THE INVENTION

This specification includes an account of the background of the invention, a description of the the best mode presently contemplated for carrying out the invention, and appended claims.

FIELD OF THE INVENTION

This invention relates to color cathode ray picture tubes, and is addressed specifically to improved electrical conduction means for use in a color cathode ray tube having a tensed foil shadow mask. The invention can find application in color tubes of various types, including those used in home entertainment television receivers, and in medium-resolution and high-resolution tubes intended for color monitors.

The use of the tensioned foil mask and flat faceplate provides many benefits in comparison to the conventional domed shadow mask and correlatively curved faceplate. Chief among these is a greater power-handling capability which makes possible as much as a three-fold increase in brightness. The conventional curved shadow mask, which is not under tension, tends to "dome" in picture areas of high brightness where the intensity of the electron beam bombardment is greatest. Color impurities result as the mask moves closer to the faceplate. As it is under high tension, the tensioned foil mask will dome, but negligibly in comparison with the curved mask. Its relative immunity to doming provides for greater brightness potential while maintaining color purity.

The tensioned foil shadow mask is a part of the cathode ray tube front assembly, and is located in close adjacency to the faceplate. The front assembly comprises the faceplate with its screen consisting of deposits of discrete light-emitting phosphor elements, a shadow mask, and support means for the mask.

The area enclosed by the funnel and the front assembly of a color cathode ray picture tube is typically established as a field-free region for the excursion of the electron beams that selectively excite the phosphor elements. The field-free region is established by charging the inner surfaces of the funnel and faceplate and the adjacent components to a high potential, typically in the range of 20–30 kilovolts. The surfaces so charged include the conductive coating deposited on the inner surface of the funnel, and an electrically conductive film, usually aluminum, disposed on the back of the picture imaging screen. The shadow mask must also be charged to the same high potential. The electrically conductive coating on the inner surface of the funnel receives a high potential from a metallic "anode button" that protrudes through the wall of the funnel, and which in turn is connected to a conductor leading to an high voltage power supply. It is essential that an electrical path be established between the inner conductive coating, the screen, the shadow mask, and any component linked thereto to establish the field-free region.

A typical anode contact spring for use in the conventional curved mask/curved faceplate cathode ray tube is disclosed in U.S. Pat. No. 4,333,033 to Cordingly et al, of common ownership herewith. The spring provides for an electrical path from the electrically conductive coating to the skirt of the shadow mask to energize the mask with high voltage. The novelty of the spring lies in its means of attachment to the skirt of the mask, wherein the spring can be clipped onto the skirt with an anti-twistoff locking feature.

In U.S. Pat. No. 4,450,379, Kikuchi et al discloses an anode contactor for use in a cathode ray tube having a flat faceplate. The contactor consists essentially of a flat plate that extends substantially along the inner surface of the funnel and into the faceplate area. One end of the plate is in contact with the anode button, with attachment to the button made by what appears to be a rivet. The other end of the plate is in contact with the screen. The configuration of the tube makes possible the use of a contactor of relatively straightforward design as there appear to be no barrier to the direct conduction of high voltage from the anode button to the screen. Other representative electrical conductive means are disclosed in U.S. Pat. Nos. 3,898,510 to Davis et al, and 3,432,803 to Nice.

OBJECTS OF THE INVENTION

It is an object of the invention to provide improved means for conducting high voltage to the screen and shadow mask in cathode ray tubes having a tensed foil shadow mask and a substantially flat faceplate;

It is another object of the invention to provide means for the high-voltage energizing of internal components of a cathode ray tube having a tensed foil shadow mask mounted on a component that serves as a barrier to electrical conduction.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
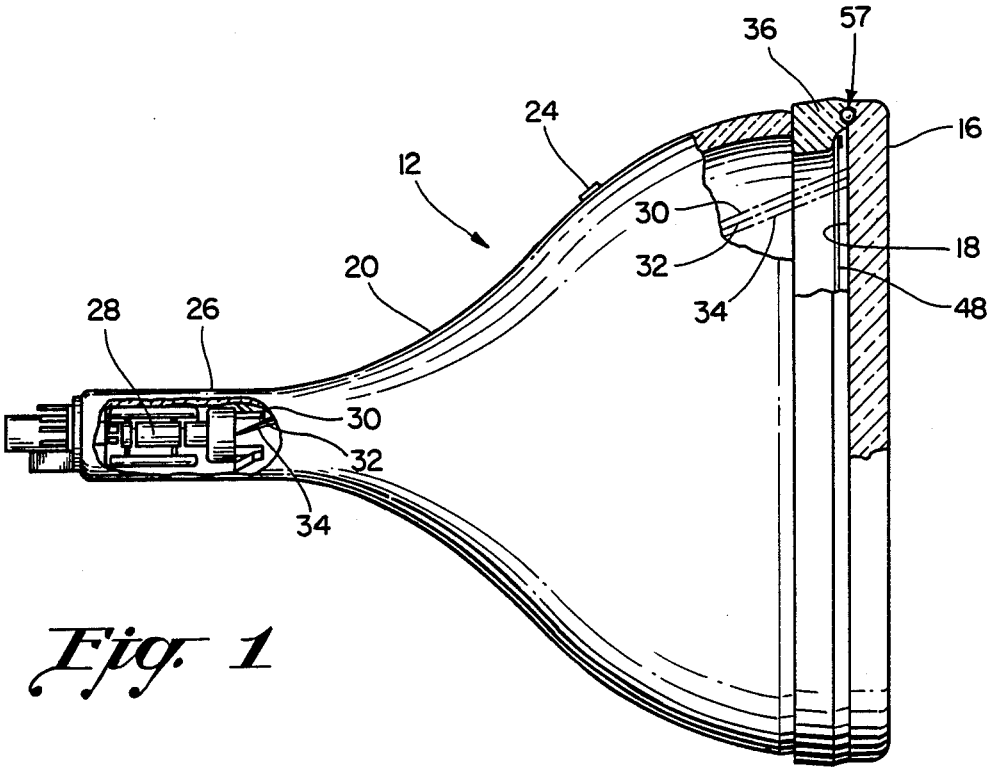
FIG. 1 is a side view in elevation of a color cathode ray tube envelope having an improved high voltage conduction means according to the invention, with cut-away sections that indicate the location and relationship of major tube components.
Figure 2:
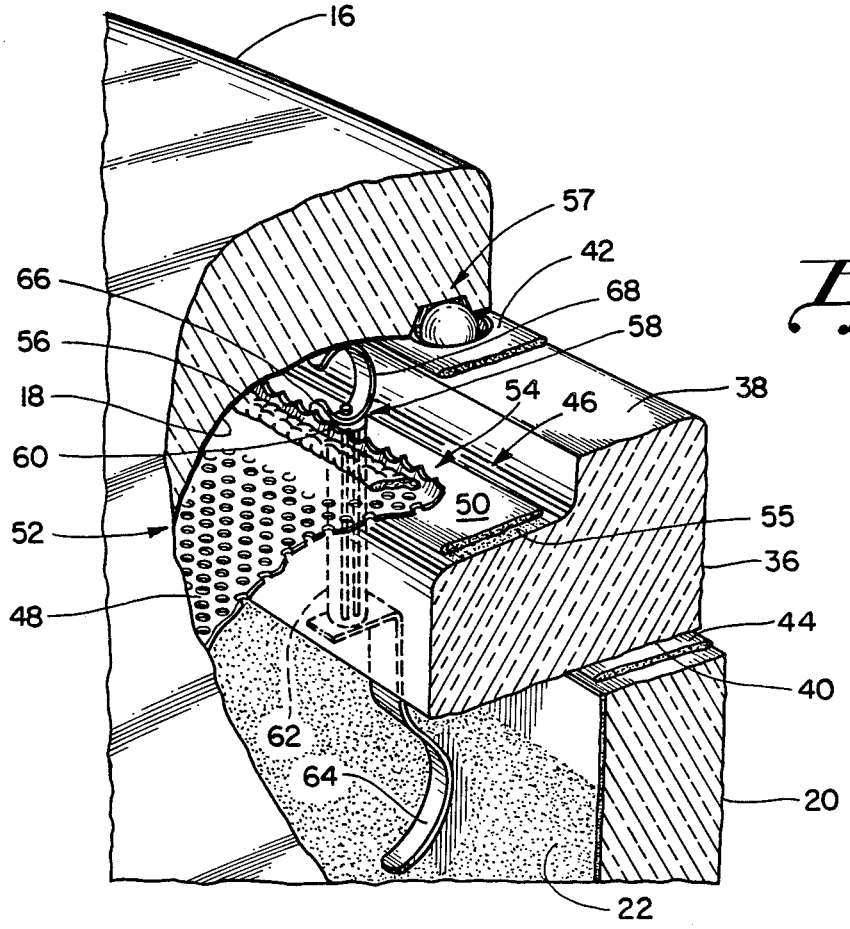
FIG. 2 is a perspective view partly cutaway of a frontal section of the tube envelope of FIG. 1 depicting the relationship of an embodiment of the high voltage conduction means according to the invention with the faceplate and screen, funnel, tensed foil shadow mask, and shadow mask support assembly.

FIGS. 1 and 2 depict a novel high-resolution cathode ray tube 12 having an envelope that includes a glass faceplate 16 with an electrically conductive phosphor screen 18 made electrically conductive by virtue of a deposit of metallic film thereon which typically comprises aluminum. The envelope of tube 12 includes a funnel 20 having an electrically conductive film 22 on its inner surface; film 22 is charged to a high electrical potential typically in the range of 20 to 30 kilovolts. The high voltage potential is indicated as being supplied through an anode button 24 connected in turn to a high-voltage power supply (not indicated) as is well known in the art. Funnel 20 is shown as tapering down to a narrow neck 26 depicted as enclosing an electron gun 28. Gun 28 is represented as projecting three electron beams 30, 32 and 34 onto the screen 18 of faceplate 16. The screen 18 on the inner surface of faceplate 16 comprises deposits of phosphor elements (not indicated) which comprise triads of red-light-emitting, green-light-emitting, and blue-light-emitting phosphors which emit light when excited by respective ones of the electron beams 30, 32 and 34.

As indicated by FIG. 1, and in greater detail by FIG. 2, an electrically insulative glass shadow mask support assembly 36 is depicted as being sealed between the sealing surfaces of faceplate 16 and funnel 20. Mask support assembly 36 is represented as having first and second plano-parallel spaced apart sealing surfaces 38 and 40, with sealing being accomplished by layers 42 and 44 of devitrifying frit cement. As a result, the color electrode assembly 36 is sealed between faceplate 16 and the funnel 20 so as to become an integral part of the envelope.

Shadow mask support assembly 36 is depicted as having a shelf 46 extending into the tube envelope for mounting a metallic foil shadow mask 48 in tension adjacent to screen 18. The mask 48 as mounted will be noted as being flat and parallel with the screen 18. Shelf 46 is indicated as comprising a peripherally continuous recessed support surface, attachment of the mask 48 to shelf 46 is indicated as being by means of a layer of cement 50. Shadow mask 48 is indicated as having a first field 52 of apertures therein which provide for color selection in the finished tube, and a second field 54 of apertures peripheral to the first field 52. The second field 54 of peripheral apertures comprise cement-passing apertures sized to pass cement in its viscous state, indicated as comprising layer of cement 56. A layer of conductive frit 55 may underlie the second field 54 of apertures of shadow mask 48 to ensure positive electrical contact. The embodiment of the shadow mask 48 as shown and the means of mounting is not the subject of the present application, but is described and claimed in referent copending application Ser. No. 729,020.

The layers of frit cement 42, 44 and 50 may comprise a devitrifying glass frit such as that supplied by Corning Glass Works of Corning, N.Y. under the designation Glass 7595. A devitrifying frit is compounded as a viscous glass which crystallizes and hardens when heated to a predetermined temperature, and which does not remelt upon reheating to that temperature, so that a permanent bond is made that is unaffected by the heat of final assembly.

Tube 12 is indicated as having internal indexing means 57 for the registration of faceplate 16 and the shadow mask support assembly 36. The sets of indexing means, typically three in number, are internally spaced at preselected locations about the periphery of the faceplate 16; one of the sets is indicated in FIGS. 1 and 2 by reference number 57. Indexing means 56 in this prior art embodiment is depicted as comprising a ball which rides in mating grooves in the sealing surfaces of the faceplate and mask support assembly 36. The indexing means shown and variations thereof are not the subject of the present application but are described and fully claimed in various ones of the referent copending applications Ser. Nos. 572,088 and 572,089; Ser. No. 735,887; and Ser. No. 727,486.

Figure 3:
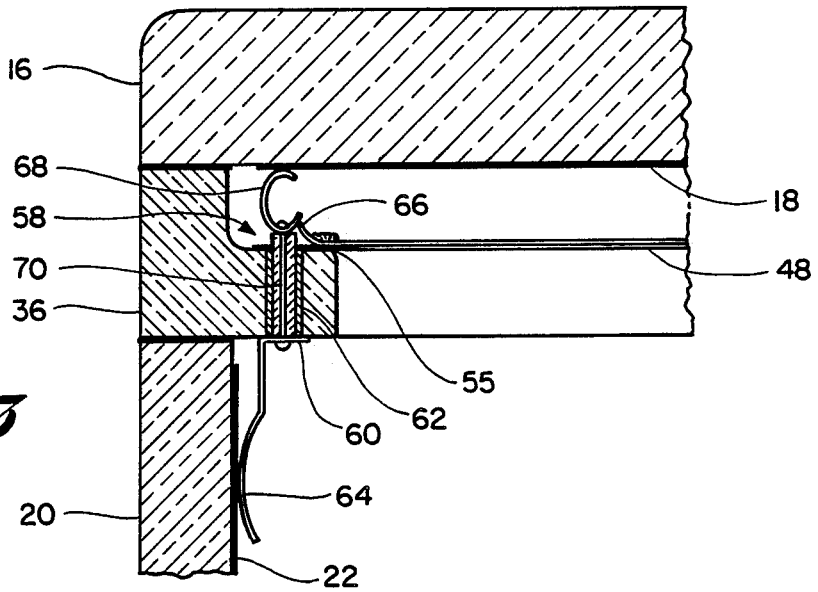
FIG. 3 is a view in elevation and in section of the tube frontal assembly showing additional details of the electrical conduction means shown by FIG. 2.

Shelf 46 has at least one hole therethrough for receiving electrical conduction means according to the invention, as shown by hole 58 in FIGS. 2 and 3. Electrical conduction means 60 includes a central member 62 for insertion into hole 58. Electrical conduction means 60 according to the invention also includes contacting means at both extremities for contacting the electrically conductive coating 22 on funnel 20, the shadow mask 48, and the metallic film on screen 18. The contacting means for the embodiment of the invention depicted in FIGS. 2 and 3 are indicated as being resilient spring means 64 on one extremity of electrical conduction means 60 for contacting conductive coating 22 on funnel 20 and on the other extremity, resilient spring means 66 shown as contacting shadow mask 48, and resilient spring means 68 depicted as contacting screen 18. As a result, and according to the invention, the high electrical potential on conductive film 22 on funnel 20 is conducted through the electrically insulative glass shadow mask support assembly to the shadow mask 48 and the screen 18 to establish the components at a common high potential.

The center member 62 of electrical conduction means 60 is depicted as being a rod-like member having its extremities the resilient spring means described. Center member 62 is according to the invention, a mechanically expansible member for insertion into hole 58 and locking into hole 58 in shelf 46. The mechanical expansion according to the invention may be accomplished by the compressive effect of rivet means 70 upon rod-like member, which may be comprised of a material which expands under the compression of the rivet means 70. The heads of the rivet are indicated as retaining the springs means at the extremities. Alternately, rod-like center member 62 may comprise a tube with a number of lateral slits therethrough which will result in the expansion of the tubing under the compression of the rivet means 70. The electrical conduction means is hence permanently locked into the hole after its insertion. Alternatives to the rivet means of assembly may comprise compression bolts, locking screws, or studs, by way of example.

Figure 4:
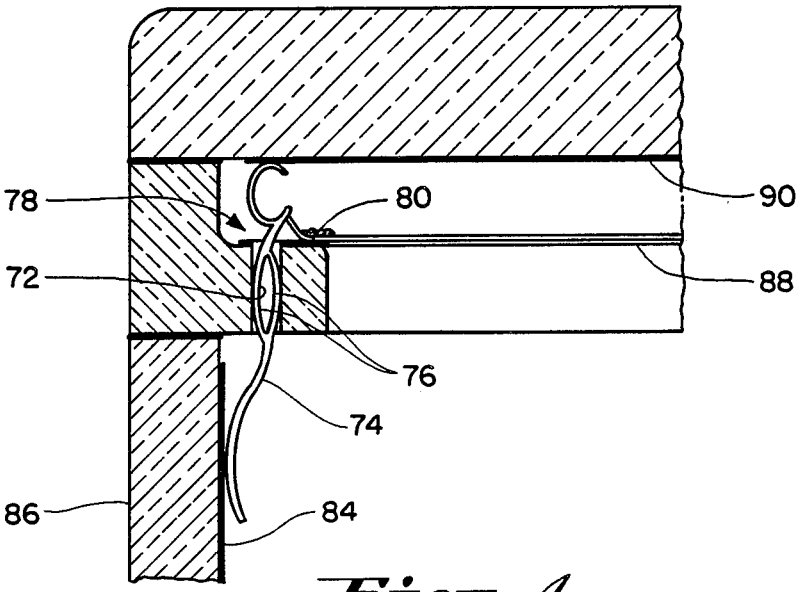
FIG. 4 is a view similar to FIG. 3 depicting another embodiment of the electrical conduction means according to the invention.

Another configuration of an electrical conduction means according to the invention is depicted in FIG. 4. In this embodiment, the center member 72 of electrical conduction means 74 comprises a multiform spring means depicted as having a spread, but contractible, center 76 which provides for press-fitting of the electrical conduction means into hole 78 of shelf 80. Electrical conduction means 74 according to the invention will be noted as having resilient contacting means at both extremities for contacting the electrically conductive coating 84 on funnel 86, the shadow mask 88, and the metallic film on screen 90. A benefit of this embodiment lies in the fact that the electrical conduction means may be installed easily, and just as easily removed in tube reclamation.

While a particular embodiment of the invention has been shown and described, it will be obvious to those skilled in the art that changes and modifications may be made in the inventive means without departing from the invention in its broader aspects, and therefore, the aim of the appended claims is to cover all such changes and modifications as fall within the true spirit and scope of the invention.

We claim:

1. A color cathode ray tube having an envelope including a faceplate with an electrically conductive screen, a funnel having an electrically conductive film on its inner surface charged to a high electrical potential, and an electrically insulative glass shadow mask support assembly sealed between said faceplate and said funnel and having a shelf extending into said envelope for mounting a metallic foil shadow mask in tension adjacent to said screen, said shelf having at least one hole therethrough for receiving electrical conduction means, said electrical conduction means including a center member for insertion into said hole, and contacting means at both extremities for contacting said electrically conductive coating on said funnel, said shadow mask, and said electrically conductive screen, whereby the high electrical potential on said conductive film of said funnel is electrically conducted through the electrically insulative glass shadow mask support assembly to said shadow mask and said screen to establish the components at a common high potential.

2. The color cathode ray tube according to claim 1 wherein said center member of said electrical conduction means comprises a rod-like, mechanically expansible member for insertion through and locking into said hole in said shelf.

3. The color cathode ray tube according to claim 1 wherein the center member of said electrically conductive means comprises multiform spring means having a spread but contractible center section for press-fitting into said hole in said shelf.

* * * * *